US009595764B2

(12) United States Patent
Loftus

(10) Patent No.: US 9,595,764 B2
(45) **Date of Patent: *Mar. 14, 2017**

(54) DUAL PORT SINGLE FREQUENCY ANTENNA

(71) Applicant: Robert Francis Joseph Loftus, Sydney (AU)

(72) Inventor: Robert Francis Joseph Loftus, Sydney (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/201,536

(22) Filed: Jul. 4, 2016

(65) Prior Publication Data

US 2016/0372831 A1 Dec. 22, 2016

Related U.S. Application Data

(63) Continuation of application No. 14/195,298, filed on Mar. 3, 2014, now Pat. No. 9,413,064.

(30) Foreign Application Priority Data

Mar. 4, 2013 (AU) ..... 2013900724
Apr. 14, 2013 (AU) ..... 2013205196

(51) Int. Cl.
*H01Q 1/50* (2006.01)
*H01Q 13/10* (2006.01)
*H01Q 9/16* (2006.01)

(52) U.S. Cl.
CPC ..... *H01Q 13/106* (2013.01); *H01Q 1/50* (2013.01); *H01Q 9/16* (2013.01); *H01Q 13/10* (2013.01)

(58) Field of Classification Search
None
See application file for complete search history.

(56) References Cited

U.S. PATENT DOCUMENTS

| | | | | |
|---|---|---|---|---|
| 2,508,085 | A | 5/1950 | Alford | |
| 4,723,305 | A | 2/1988 | Phillips et al. | |
| 4,916,457 | A | 4/1990 | Foy et al. | |
| 6,806,839 | B2 | 10/2004 | Lo | |
| 8,129,607 | B2 | 3/2012 | Loftus | |
| 8,314,750 | B1 | 11/2012 | Josypenko | |
| 8,420,924 | B2 | 4/2013 | Loftus | |
| 8,749,441 | B2 | 6/2014 | Fenn | |
| 9,413,064 | B2 * | 8/2016 | Loftus | H01Q 13/106 |
| 2007/0117524 | A1 | 5/2007 | Do | |

(Continued)

FOREIGN PATENT DOCUMENTS

| | | |
|---|---|---|
| EP | 1498982 | 1/2005 |
| JP | 62165403 | 1/1986 |

(Continued)

OTHER PUBLICATIONS

Deal, William R., et al., "Integrated-Antenna Push-Pull Power Amplifiers", IEEE Transactions on Microwave Theory and Techniques, vol. 47, No. 8, Aug. 1999, 8 pp.

(Continued)

*Primary Examiner* — Robert Karacsony
(74) *Attorney, Agent, or Firm* — Trenner Law Firm, LLC; Mark D. Trenner

(57) ABSTRACT

An antenna further comprising a first port, a second port, so constructed and arranged that the first port is 180-degrees out of phase with respect to the second port.

11 Claims, 6 Drawing Sheets

(56) References Cited

U.S. PATENT DOCUMENTS

| | | | |
|---|---|---|---|
| 2007/0207747 | A1 | 9/2007 | Johnson et al. |
| 2008/0297419 | A1 | 12/2008 | Dou et al. |
| 2009/0108954 | A1 | 4/2009 | Cheung et al. |
| 2010/0156726 | A1 | 6/2010 | Montgomery et al. |
| 2010/0208844 | A1 | 8/2010 | Uhl et al. |
| 2012/0299792 | A1 | 11/2012 | Montgomery |
| 2013/0106667 | A1 | 5/2013 | Fenn et al. |
| 2013/0135158 | A1 | 5/2013 | Faraone |
| 2014/0266940 | A1 | 9/2014 | Vale |

FOREIGN PATENT DOCUMENTS

| | | |
|---|---|---|
| JP | 62165403 | 7/1987 |
| JP | 2008092491 | 10/2009 |
| WO | 2008131157 | 10/2008 |
| WO | 2010075406 | 7/2010 |

OTHER PUBLICATIONS

Patent Examination Report No. 2, for AU Appiication No. 2013205196, dated Jul. 17, 2014, 6 pp.
Patent Search Report for GB Application No. GB1403385.6, dated Aug. 1, 2014, 4 pp.
Patent Examination Report No. 1, for patent application No. AU 2013205196, Nov. 7, 2013, 4 pp.
Patent Examination Report No. 3 dated Oct. 24, 2014 for corresponding AU patent application 2013205196.
IEEE Transactions on Micowave Theory and Techniques, Vo1.47, No. 8, Aug. 1999, W R Deal et al, "Integrated-antenna push-pull power amplifiers", pp. 1418-1425 (see figs.2 & 8).
UK Search Report dated May 19, 2016 for corresponding GB patent application 1403385.6.
English Abstract of JP2008092491.
English Machine Translation of JP2008092491.

* cited by examiner

Single Feed Slot Antenna

Dual Feed Slot Antenna

DUAL PORT SINGLE FREQUENCY ANTENNA

CROSS REFERENCE TO RELATED APPLICATIONS

This application is a continuation of U.S. patent application Ser. No. 14/195,298 filed Mar. 3, 2014 titled "A Dual Port Single Frequency Antenna" of Robert Loftus, which claims the benefit of priority from the following applications filed in the name of applicant and inventor Robert Loftus (a) AU provisional patent application number 2013900724 entitled "A Dual Feed Single Frequency Antenna" filed on Mar. 4, 2013 and (b) AU standard patent application number 2013205196 entitled "A Dual Port Single Frequency Antenna" filed on Apr. 14, 2013; the contents of each of the applications are incorporated herein by reference for all that is disclosed (as if recited below).

BACKGROUND OF INVENTION

Technical Field

The present invention pertains to the field of antennas.

Background Art

The transmission and reception of fields, including electromagnetic fields and ultrasonic fields, from a source to a target has met with a plurality of difficulties that have affected the cost and complexity of construction of antennas and antenna systems.

SUMMARY OF INVENTION

General problems with the background art, as identified by the inventor, include:

the need to solve the problem of isolating transmitted and received fields when using an antenna.

Specific problems with the background art, as identified by the inventor, include:

determining how to transmit and receive fields from a single antenna without interference between transmitted and received fields;

to simplify antenna system design;

to reduce the cost of construction of antenna systems.

Technical Problem

To ameliorate some of the effects of the general problems and the specific problems as recited above and in particular to provide, at least in part, an antenna that avoids the need to isolate transmitted and received fields using separate antenna systems.

Technical Solution

The technical solution includes:

ensuring that transmitted and re-radiated fields are 180-degrees out of phase (for purposes of field and signal isolation);

transmitting and receiving fields to and from a single antenna;

using the same frequency for transmission and reception of fields.

Advantageous Effects

Advantageous effects include:

the use of a single antenna for transmission and reception minimizes construction complexity and the cost of an antenna;

an ability to transmit and receive at a same frequency minimizes operational complexity of an antenna;

the use of transmitted and received fields that are 180-degrees out of phase with respect to one another minimizes the prospect of interference between transmitted and received fields because the only signals produced, if any, prior to mixing, as a result of signal interaction (cross talk), are either null signals, additive signals or subtracted signals—isolation of signals being achieved, in substance, by a 180-degree phase shift upon re-radiation of a field from a target.

A method for operating an antenna including: deriving an output signal from the antenna at a port that is 180-degrees out of phase with respect to a port associated with the antenna's input signal.

DETAILED DESCRIPTION

Best Mode

Definitions and Terms

The description in the body of the specification pertains to preferred modes of invention. Accordingly, features recited in the body of the specification should not be construed to be essential features of the invention unless explicitly indicated. Furthermore, any reference in the body of the specification to the expression "invention" should be construed as a reference to preferred embodiments only.

Words to the effect of "a 180-degree phase shift" refer to an inversion of a periodic waveform upon reflection off a target (where dimensions have been scaled to 360-degrees for purposes of discussion of a full wave period).

The word "antenna" is to be understood to mean "a device for converting electromagnetic radiation in space into electrical currents in conductors or vice-versa, depending on whether it is being used for receiving or for transmitting, respectively" (National Radio Astronomy Observatory (US), http://www.nrao.edu/).

The expression "where the first port is 180-degrees out of phase with respect to the second port" means that the first port and the second port are inherently 180-degrees out of phase in the sense that when the antenna, the subject of the claims, is excited, a signal at the first port of the antenna, will not appear at the inverted second port of the antenna because the signal at the inverted second port is 180-degrees out of phase with respect to the signal at the first port—port isolation occurs exclusively as a result of the physical location of the first and second ports, that is, the 180-degree phase shift depends upon port location and is independent of the other devices, including, but not limited to, phase splitters, circulators, combiners and signal processing software that could otherwise be used to deliver signals of different phase to different ports.

The expression "inverted second port", in the context of "a first port" and "an inverted second port", means that the second port is electrically inverted with respect to the first port.

Figure 1:
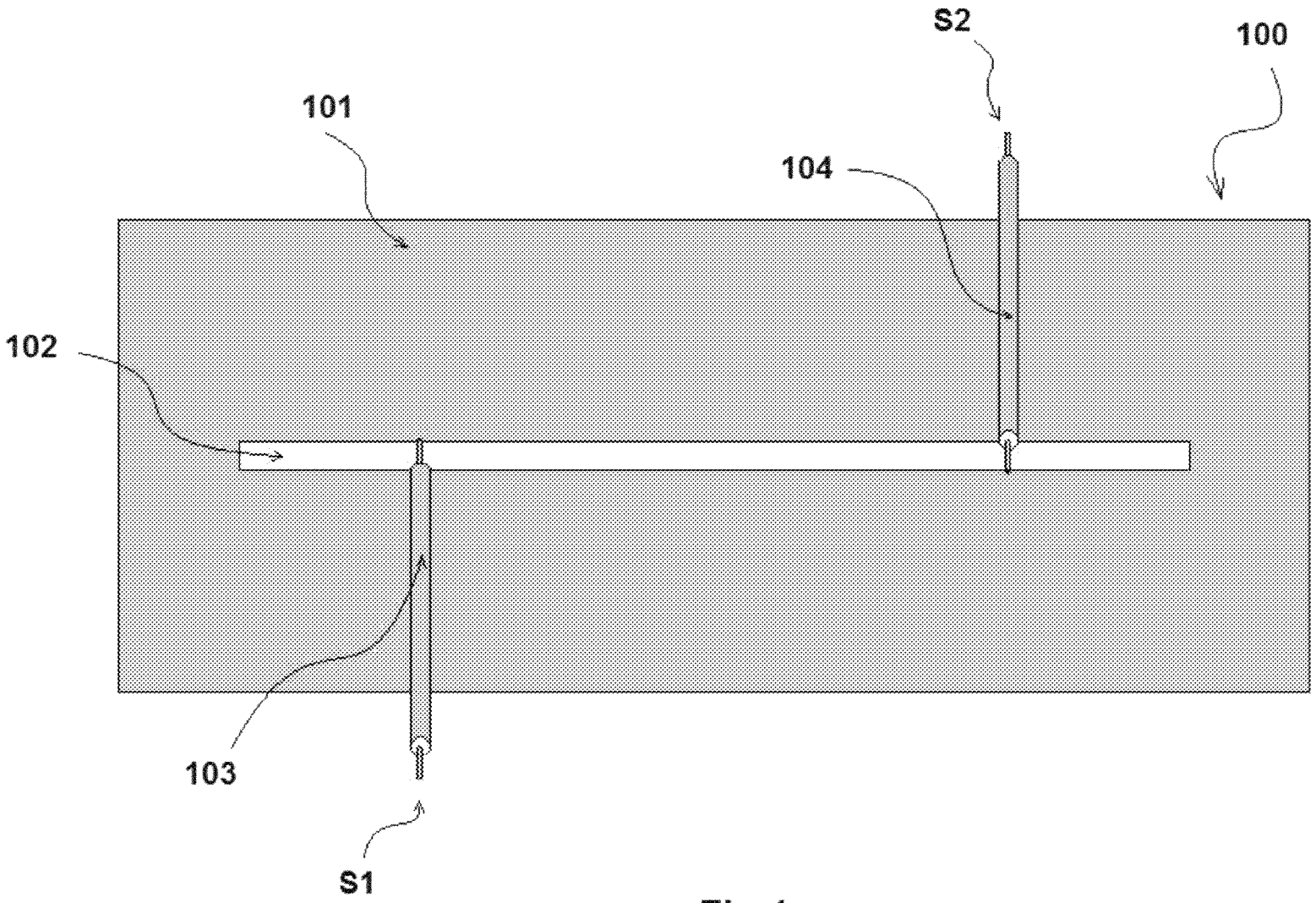
FIG. 1 shows a schematic view of a first embodiment of a dual feed, single frequency slot antenna.

FIG. 1 is an illustration of a dual feed, dual port, antenna 100 according to one embodiment of the present invention. The feeds 103, 104 used in this embodiment are constructed from 50-ohm coaxial cable. However, other feed structures could also be used including micro-strip printed circuit transmission lines.

A microwave frequency, thin slot antenna 100 is used in this embodiment of the invention. Other antennas including dipole antennas, so configured, to be driven in dual port, dual feed mode can also be used. Further, as the basic design and feed matching of microwave thin slot antennas are well known to those skilled in the art of microwave transmission and reception, only the arrangements pertinent to the implementation of embodiments of the present invention will be discussed.

The dual feed, single frequency antenna 100 includes a substantially planar electrically conductive ground plane (plate) 101 with a thin slot aperture 102, a first feed 103 and a second inverted feed 104. Both feeds in this embodiment are parallel to and connected to the conductive ground plane (plate) 101 (the requirement of parallel orientation being preferred, desirable according to one embodiment of the present invention but not mandatory). Additionally, a plane (plate), having a slot of any shape can be used, provided that the total internal perimeter of the slot is a full wavelength where measurement includes, for wavelength purposes, the top and bottom of the slot.

The coaxial feed structure's outer screen is connected to the ground plane 101. Both the inner and outer conductors of each feed are connected across the aperture 102 at the two points where the aperture impedance exactly matches the characteristic impedance (50 ohms in this case) of each coaxial feed. However, different feed structures of different impedance, requiring matching of the feeds to the antenna at different points of connection (ports) on the antenna can also be used, provided that the feed connection points (ports) in the case of a slot antenna are diametrically opposite each other with respect to the centre of the slot in order to ensure that the two feed connection points (ports) are 180-degrees out of phase with respect to each other.

Figure 2:
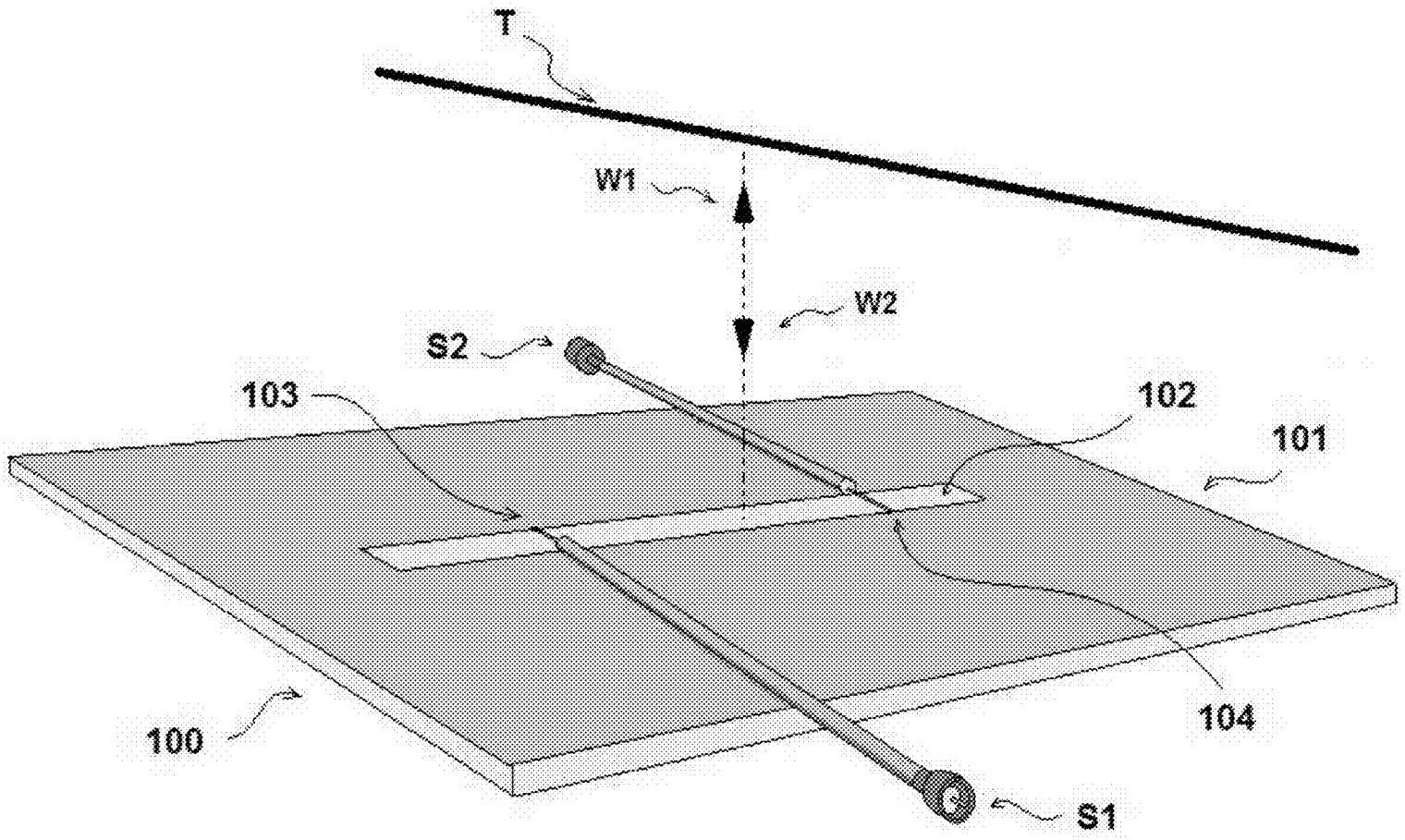
FIG. 2 shows a perspective view of an antenna that illustrates transmission towards a target and reception from the target, of field paths pertaining to a dual port, dual feed, single frequency antenna according to one embodiment of the present invention.

FIG. 2 shows the transmitter signal S1 being applied to first feed 103 (at the input port), which in turn excites the antenna at the aperture 102. The region of the slot antenna at the aperture 102 then radiates W1 (a transmitted electromagnetic field) towards a target T, in this case a metal string. Upon reaching the target T, the radiated wave W1, in this case a microwave undergoes a 180-degree phase reversal as W1 is reflected and is re-radiated back in the form of W2 off the target T towards the antenna 100. Field W2 then excites the antenna at the aperture 102 to produce a received signal S2 that is tapped at the point of connection to the antenna (an output port) associated with the second feed structure 104. However the output port associated with outgoing feed 104 is a further 180-degrees out of phase with respect to the input port associated with incoming feed 103, as a result of current reflection at the ends of the slot), accordingly, S2 (being the result of two 180-degree phase shifts one at the target T and one internally within the antenna 100 at the ends of the aperture is now in phase with respect to S1.

The above discussion pertains to the application of embodiments of the invention to standard half wavelength slot antennas. Different multiples of wavelengths can also be used provided that: the position for input (the input port) and the position for output (the output port) are appropriately selected so as to produce and receive radiation (the ability to deliver power to an antenna and also to take power out of the antenna at positions of theoretically non-infinite impedance) and also that the slot length is sufficiently dimensioned to provide a secondary port associated with the outgoing (second) feed 104 so that the incoming signal S1 is in-phase with respect to the outgoing signal S2 (S2 being in phase with respect to S1 as a result of two 180-degree phase shifts, one at the target and one internally within the antenna at endpoints of the slot (aperture). Similarly, as recited above, feeds having different ohmic values can be connected across edges of the slot—impedance matching then occurring at different feed connection points (ports) on the slot. Additionally, different types of antennas including dipole antennas can also be used.

Figure 3A:
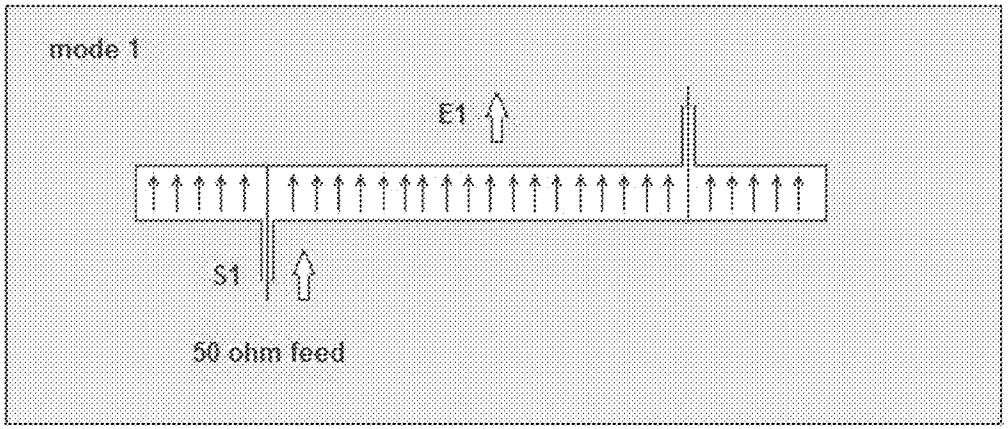
FIGS. 3A and 3B provide qualitative representations of the phase differences (between transmitted and received fields) as seen in the aperture of a slot antenna.
Figure 3B:
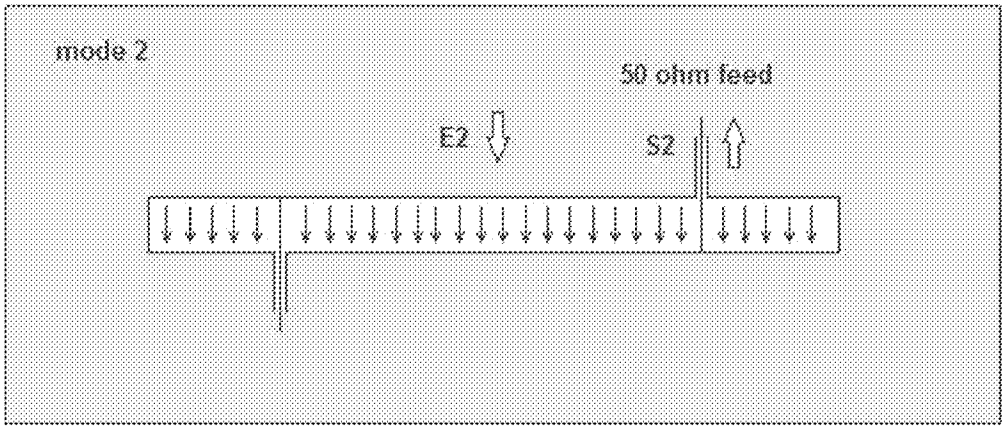

FIGS. 3A and 3B, illustrates a dual mode of operation of an antenna in qualitative form. Arrows being provided to indicate phase relationships between transmitted and received fields, W1 and W2 respectively. Naturally, in the case of a slot antenna, the arrows denote E-field polarization.

A representation of transmission mode is shown in FIG. 3A. Similarly reception mode is shown in FIG. 3B. The 180-degree phase difference between fields W1 and W2 can be seen from the arrows within the slot in FIGS. 3A and 3B, which pertain to the effect of E-field polarization in the antenna. It is to be noted that S1 and W1 are in phase as seen in FIG. 3A. Next, it is noted from FIG. 3B that W2 is in phase with respect to the internal voltage and electric fields produced by W2. However, it is important to note that the point of connection (port) for the outgoing feed for S2 is 180-degrees out of phase with respect to the point of connection (port) for the incoming feed for S1 (see points of connection (ports) associated with feed structures 103 and 104 in FIG. 1). Accordingly, S2 leaves the antenna 100 at the point of connection (port) associated with feed 104 in phase with respect to S1 because S2's antecedent signal and field have collectively undergone two 180-degree phase shifts, bringing S2 back into phase with S1—the first phase shift occurring at the target and the second phase shift occurring inside the antenna by way of internal reflection of current at the ends of the slot 102 (currents on the top and bottom of the slot travelling in opposite directions).

Figure 4:
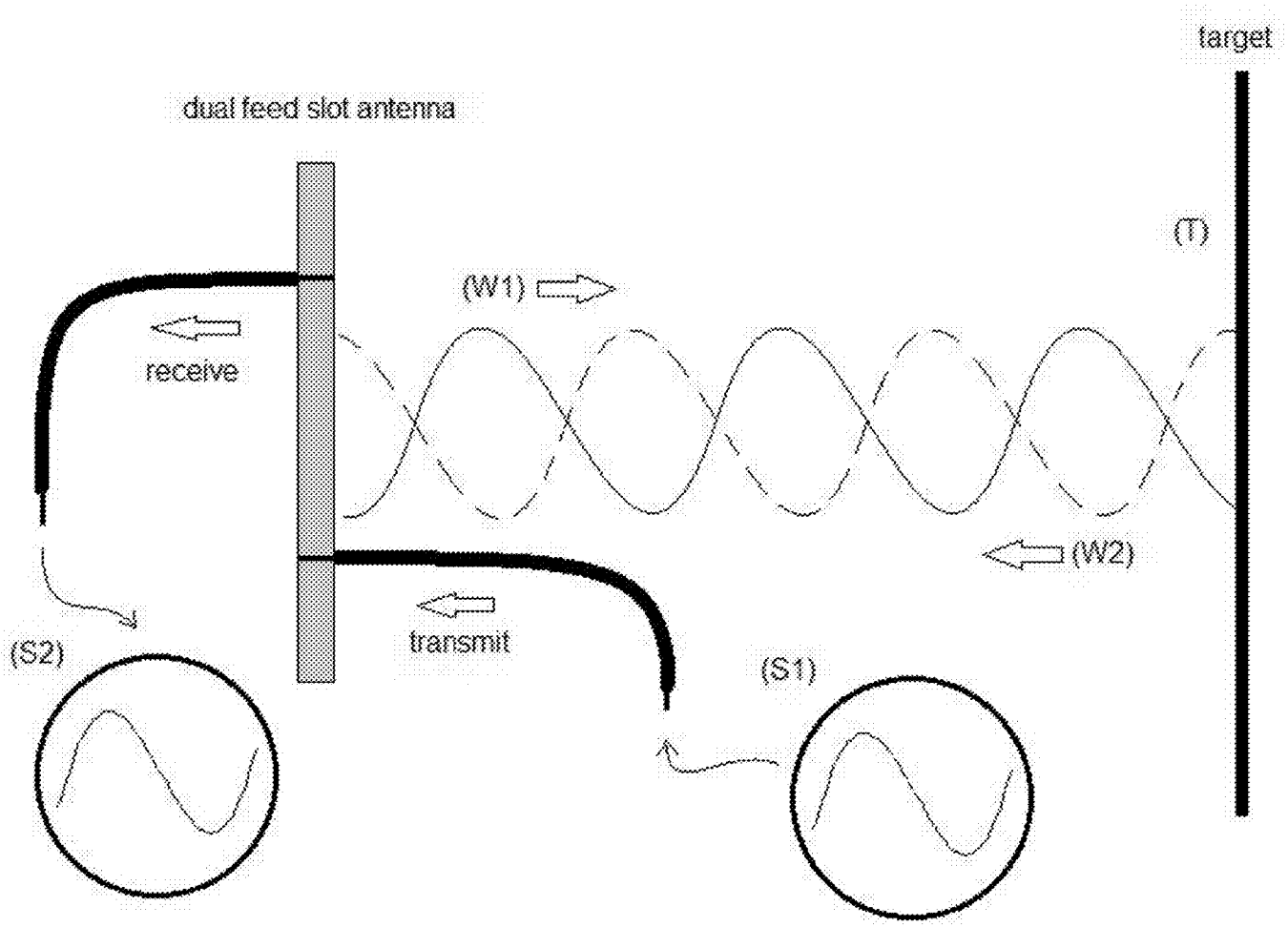
FIG. 4 provides a qualitative representation of the field paths and phasing of the transmitted and received fields between source and target.

FIG. 4 illustrates fields in both transmission and reception modes according to one embodiment of the present invention. Note the phase inversion between W1 and W2 at the target. Furthermore, note the effect of the additional phase inversion that occurs within the antenna (as a result of current reflection at the slot's ends) thus bringing S2 back into phase with respect to S1 (as seen by the currents depicted in the circles).

Figure 5:
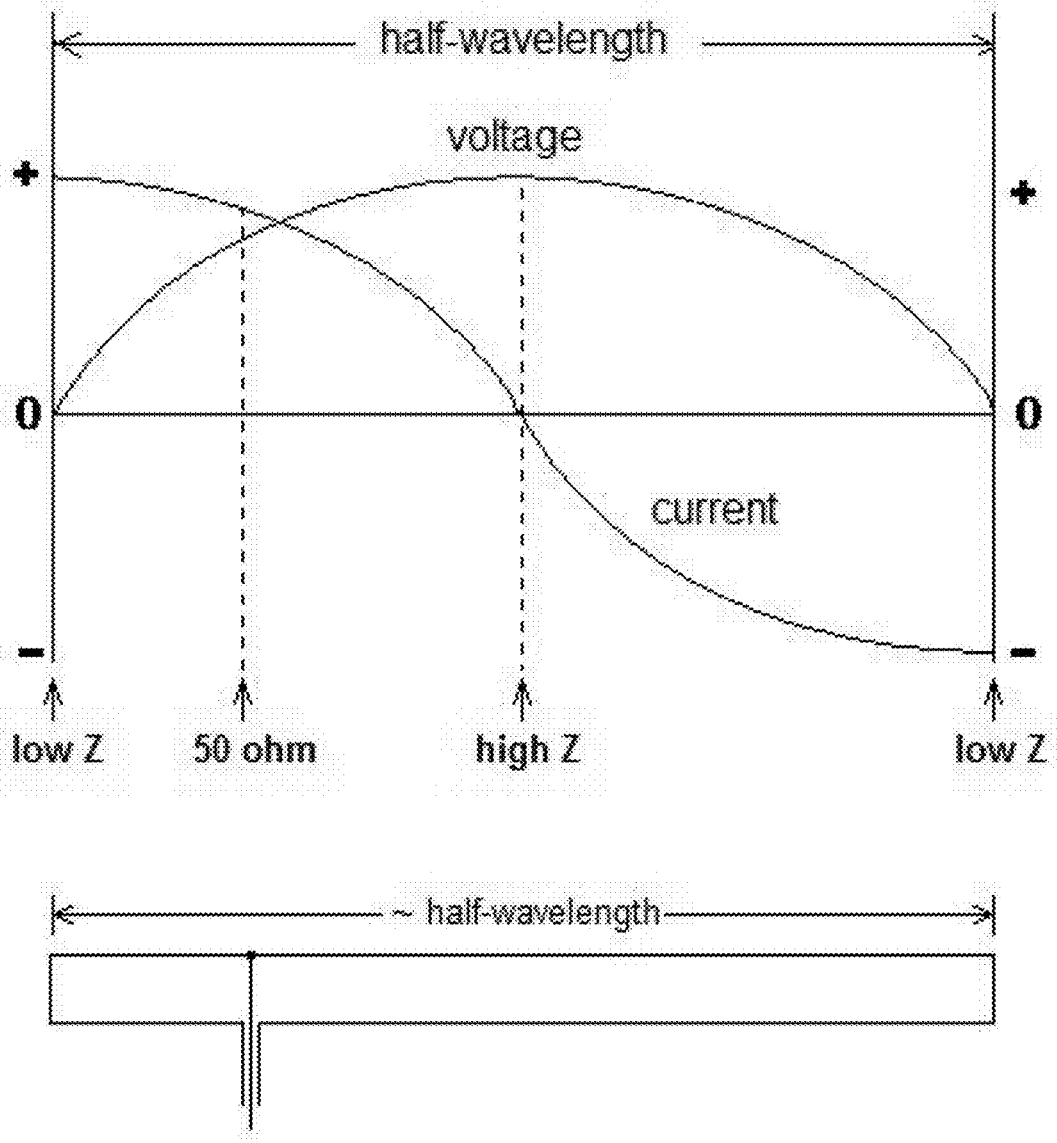
FIG. 5 shows voltage and current over a half-wave length of a single feed, single port, slot antenna.

FIG. 5 shows voltage and current over a half-wave length, single feed, single port, slot antenna. FIG. 5 also shows impedance matching points for use in association with 50-ohm coaxial cable.

Figure 6:
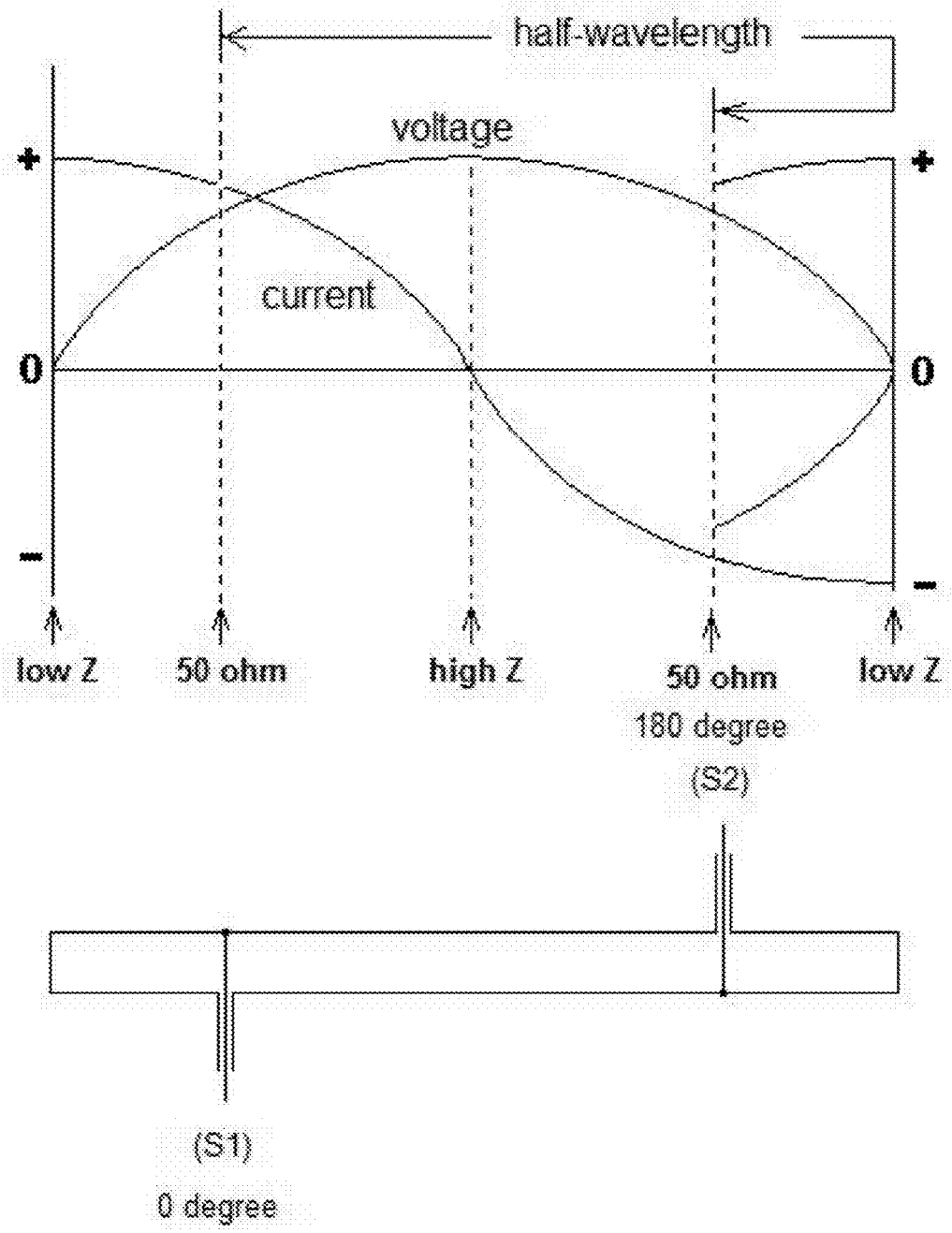
FIG. 6 shows voltage and current over a half-wave length of a dual feed, dual port, slot antenna.

FIG. 6 shows the voltage and current over a half-wave length, dual feed, dual port, slot antenna. FIG. 6 also shows the 50-ohm impedance matching points used in this embodiment of the present invention. Further, as previously recited, the antenna voltage has a 180-degree phase difference between the two 50-ohm feeds.

Mode of Invention

Embodiments of the present invention recited above pertain to transmission and reception of electromagnetic radiation. However, any waveform can be used, including the use of ultrasonic fields. Additionally, a plurality of differing targets including nylon and metal strings can also be used in association with fields operating at frequencies sufficient for detection of 180-degree shifting of reflected signals. The above description pertains to the description of a dual feed, dual port, slot antenna. However, other antenna structures, including a dipole antenna can also be used. The only restriction once again on the use of a dipole antenna is that the dipole antenna must be of sufficient length to enable a first feed 103 and second feed 104 to be tapped in at the antenna at points of connection (ports) that will match the impedance of the incoming and outgoing feeds for S1 and S2 to the antenna impedance and also to ensure that the secondary connection point (port) at which feed 104 is connected to the antenna is 180-degrees out of phase with respect to the input connection point (port) at which feed 103 is connected to the antenna.

Embodiments of the present invention recited under Best Mode pertain in general to microwave transmission. However, just as variation from one waveform structure to another (electromagnetic to ultrasound) can occur, variations in frequency can be used within the electromagnetic spectrum and similarly within the scale of frequencies applicable to sound vibrations (restriction to ultrasound frequency ranges being preferred only).

Industrial Applicability

One aim of embodiments of the present invention is to overcome some of the problems associated with using multiple antennas to simultaneously transmit and receive signals, including radio signals, on substantially the same frequency. More specifically, another aim of the present invention is to maintain a high degree of isolation between transmitted and received signals.

Embodiments of the present invention provide a structurally simple solution to the problems associated with the transmission and reception of electromagnetic signals and in particular, continuous microwave signals at the same frequency. Embodiments of the present invention have commercial applications in areas including movement detection, ranging, speed detection, vibration detection and medical imaging. The antenna's first port and the antenna's inverted second port can also be used for either: (a) simultaneous transmission on both ports; (b) simultaneous reception on both ports; (c) simultaneously receiving a first signal on the first port and transmitting a second signal on the inverted second port or (d) simultaneously transmitting a first signal on the first port and receiving a second signal on the inverted second port—these embodiments being consistent with use in communications, repeaters, radar, imaging and zero-IF reception techniques. The above embodiments can be further generalized to include any frequency within the electromagnetic spectrum including visible light, infrared, ultraviolet and also frequencies applicable to lasers. Similarly, while a slot antenna has been recited as being preferred, different types of antennas can be contemplated including but not limited to, folded dipole and quad antennas, provided that the antennas are so constructed and arranged that the first and inverted second feed are 180-degree out of phase with each other.

The invention claimed is:

1. A method for using a single frequency electromagnetic antenna arrangement having a single antenna, comprising:

providing a first port location and an inverted second port location, both on the single antenna, intrinsically 180-degrees out of phase relative to one another;

wherein the first port location and the inverted second port location are distinct relative to one another;

wherein the first port location and the inverted second port location are spaced apart from one another;

enabling operating the antenna on a single frequency for simultaneous transmission and/or reception of electromagnetic waves to minimize interference between the first port location and the inverted second port location.

2. The method of claim 1, wherein the single antenna is a half wavelength antenna.

3. The method of claim 2, wherein the antenna is a slot antenna.

4. The method of claim 3, wherein the first port location and the inverted second port location are located on the single antenna at points electrically opposite each other with respect to an electrical center of the slot antenna.

5. The method of claim 4, wherein a first port and an inverted second port have equal impedance.

6. The method of claim 5, wherein the single antenna is symmetric.

7. The method of claim 6, further comprising configuring the single antenna to operate at a microwave frequency.

8. A single frequency transmit and receive electromagnetic antenna arrangement for operation on a single frequency for simultaneous transmission and/or reception of electromagnetic waves that are 180-degrees out of phase, comprising:

means providing a first port and an inverted second port intrinsically 180-degrees out of phase on a single antenna;

wherein the first port and the inverted second port are distinct from one another;

wherein the first port and the inverted second port are spaced apart from one another; and means for operating the antenna on the single frequency for the simultaneous transmission and/or reception of the electromagnetic waves at the first port and the inverted second port to minimize interference between the first port and the inverted second port.

9. The antenna of claim 8, wherein the single antenna is a half wavelength antenna.

10. The antenna of claim 9, wherein the single antenna is a slot antenna.

11. A method of using a single frequency electromagnetic antenna arrangement including a single antenna, comprising:

locating a first port and an inverted second inverted port intrinsically 180-degrees out of phase on the single antenna;

wherein the first port and the inverted second port are distinct;

wherein the first port and the inverted second port are spaced apart relative to one another;

operating the single antenna on the single frequency for simultaneous transmission and/or reception of electromagnetic waves to minimize interference between the first port and the inverted second port.

* * * * *